US007147509B1

(12) United States Patent
Burris et al.

(10) Patent No.: US 7,147,509 B1
(45) Date of Patent: Dec. 12, 2006

(54) COAXIAL CONNECTOR TORQUE AID

(75) Inventors: Donald A. Burris, Peoria, AZ (US); William B. Lutz, Glendale, AZ (US)

(73) Assignee: Corning Gilbert Inc., Glendale, AZ (US)

( * ) Notice: Subject to any disclaimer, the term of this patent is extended or adjusted under 35 U.S.C. 154(b) by 0 days.

(21) Appl. No.: 11/193,923

(22) Filed: Jul. 29, 2005

(51) Int. Cl.
*H01R 9/05* (2006.01)

(52) U.S. Cl. ..... 439/578

(58) Field of Classification Search ..... 439/578
See application file for complete search history.

(56) References Cited

U.S. PATENT DOCUMENTS

| | | | | |
|---|---|---|---|---|
| 3,212,050 | A | 10/1965 | Stark | 339/177 |
| 3,270,392 | A | 9/1966 | Demler et al. | 29/33 |
| 3,474,385 | A | 10/1969 | Cefarelli et al. | 339/47 |
| 3,715,708 | A | 2/1973 | Lloyd et al. | 339/177 E |
| 3,958,851 | A | 5/1976 | Evans | 339/47 R |
| 4,791,837 | A | 12/1988 | Main | 81/63.1 |
| 5,297,458 | A | 3/1994 | Smith et al. | 81/124.3 |
| 5,316,348 | A * | 5/1994 | Franklin | 285/39 |
| 5,352,127 | A | 10/1994 | Muller et al. | 439/188 |
| 5,367,925 | A * | 11/1994 | Gasparre | 81/121.1 |
| 5,392,508 | A * | 2/1995 | Holliday et al. | 29/751 |
| D398,493 | S | 9/1998 | Jones | D8/21 |
| 5,857,711 | A | 1/1999 | Comin-DuMong et al. | 285/38 |
| 6,276,237 | B1 | 8/2001 | Stacy | 81/55 |
| 6,293,004 | B1 * | 9/2001 | Holliday | 29/751 |
| D466,766 | S | 12/2002 | Marty et al. | D8/21 |
| 6,708,396 | B1 * | 3/2004 | Holliday | 29/751 |
| 6,716,062 | B1 | 4/2004 | Palinkas et al. | 439/578 |
| 6,817,272 | B1 | 11/2004 | Holland | 81/124.2 |
| 6,848,920 | B1 | 2/2005 | Fox | 439/133 |
| D504,113 | S | 4/2005 | Montena | D13/154 |
| 2004/0194585 | A1 * | 10/2004 | Clark | 81/124.2 |

FOREIGN PATENT DOCUMENTS

| | | |
|---|---|---|
| GB | 2 406 299 | 9/2003 |

* cited by examiner

*Primary Examiner*—Ross Gushi
(74) *Attorney, Agent, or Firm*—Joseph M. Homa; Marvin A. Glazer

(57) ABSTRACT

A coaxial connector torque aid, in the form of a tubular grip element, is installed over a conventional coaxial connector to facilitate tightening of the connector onto an equipment port by hand. The tubular grip element includes an outer surface for being grasped by a user, and an internal bore for extending over the connector body. The tubular grip element is axially-slidable for being axially advanced to extend over, and fixedly engage, an outer surface portion of the nut, simultaneously with axial compression of the connector over an end of a coaxial cable. The tubular grip element has an axial length exceeding that of the nut to make the nut more accessible.

24 Claims, 7 Drawing Sheets

COAXIAL CONNECTOR TORQUE AID

BACKGROUND OF THE INVENTION

1. Field of the Invention

The present invention relates generally to coaxial drop cable connectors, and more particularly to a gripping aid for allowing a technician to tighten such a coaxial connector to an equipment port without the need for a wrench or other special tools.

2. Technical Background

Coaxial cable connectors, such as Type F connectors, are used to attach a coaxial cable to another object such as an appliance or junction having a terminal, or port, adapted to engage the connector. Such connectors must be attached to the end of a coaxial cable using various cable preparation techniques and installation tools. Many of these connectors are compressed axially to complete the attachment process, and are hence known as "compression connectors". Once compressed onto the end of a coaxial cable, the connector is attached to various equipment ports. Often these ports are incorporated into somewhat fragile equipment, such as a DVD player or television set. Due to the sensitive nature of equipment of this type, field installers are hesitant to use a wrench to tighten a coaxial cable connector onto a port of such equipment. Additionally, consumers often disconnect coaxial cables from equipment when relocating such equipment, but consumers are not adequately trained or equipped to properly reconnect such coaxial connectors to the equipment ports following such relocation. Accordingly, the connectors may not be adequately tightened, and poor picture quality often results.

In the past, others have attempted to provide a coaxial connector assembly which avoids the need for wrenches or other installation tools when tightening the coaxial connector to an equipment port. For example, Ben Hughes Communication Products Company, doing business as CablePrep, offers a torque wrench product sold under the trademark "Wing Ding". These products are formed of plastic, are installed over an F-style coaxial connector, and include a pair of opposing wings for allowing a user greater leverage when hand-tightening the coupling nut of a coaxial connector as compared with directly grasping the coupling nut itself. However, considerable manipulation is required to install such device onto the coaxial connector and onto the coupling nut. In addition, the "Wing Ding" torque wrench provides only a relatively short area for fingers to grip. This short gripping area makes it difficult to access, and rotate, the coupling nut of the coaxial connector when the connector is installed in a recess formed in the back of a television or other video equipment, as is often the case.

Other attempts to produce a more easily grasped connector have resulted in special connectors with grip aids built in. For example, U.S. Pat. No. 6,716,062 to Palinkas, et al., discloses an F-type connector wherein the coupling nut includes a cylindrical outer skirt of constant outer diameter and a knurled gripping surface. Likewise, Visicom of Australia offers a series of RF connectors that include an elongated coupling nut having a knurled outer surface for better gripping. While such connectors provide improved gripping, they also necessitate the manufacture and stocking of a greater number of versions of F-connectors. Use of specific connectors for special applications requires that the installer be supplied with a greater number of connector types, and that the installer be knowledgeable as to a greater number of connector application requirements. The installer is also burdened with the necessity of carrying a greater number of different coaxial connectors to the job site.

Accordingly, it is an object of the present invention to provide a coaxial connector that can be easily, quickly, and reliably installed by hand over an equipment port.

Another object of the present invention is to provide a torque aid for such a coaxial connector that is easily installed onto a conventional F-connector.

Still another object of the present invention is to provide such a torque aid that is inexpensive and cost competitive.

A further object of the present invention is to provide such a torque aid that allows the coupling nut of a coaxial connector to be more easily grasped.

A yet further object of the present invention is to provide such a torque aid that avoids the need for an installer to carry extraneous specialty connectors.

Another object of the present invention is to provide such a torque aid that avoids interference with field tools currently used to secure coaxial connectors over the end of a coaxial cable.

An additional object of the present invention is to provide such a torque aid that facilitates tightening of the coupling nut of a coaxial connector when the coaxial connector is coupled with an equipment port located in a recessed area of a television set or other electronic equipment.

These and other objects of the present invention will become more apparent to those skilled in the art as the description of the present invention proceeds.

SUMMARY OF THE INVENTION

Briefly described, and in accordance with preferred embodiments thereof, the present invention relates to a method for facilitating rotation (e.g., tightening or untightening) of a coaxial connector relative to a coaxial port. The coaxial connector includes a generally-cylindrical body for receiving a prepared end of a coaxial cable. The coaxial connector also includes a nut rotatably secured to the body for securing the connector onto a coaxial port. A torque aid in the form of a tubular grip element includes an outer surface and an internal bore. The internal bore of the tubular grip element preferably has an inner diameter of at least the dimension of the outer diameter of the connector body for extending over and around the body of the connector. In a preferred embodiment, the axial length of the tubular grip exceeds the axial length of the coupling nut. The coaxial connector is preferably an axial compression-style coaxial connector.

In practicing the improved method of the present invention, the prepared end of the coaxial cable is inserted inside the body of the connector, and the body of the connector is disposed inside the internal bore of the tubular grip. While these two steps may be performed in either order, it is preferred that the prepared end of the cable first be inserted inside the body of the connector, and that the body of the connector then be disposed inside the internal bore of the tubular grip. In a preferred embodiment, the tubular grip is first slid over the prepared end of the coaxial cable and temporarily moved along the coaxial cable away from its prepared end before the prepared end of the cable is inserted into the body of the connector; the tubular grip element is then slid back toward the prepared end of the cable and over the body of the connector.

The coaxial connector, tubular grip element, and coaxial cable trailing therefrom are then preferably inserted into an axial compression tool of the type commonly used to axially compress such connectors over the ends of coaxial cables.

The compression tool is activated to axially advance the tubular grip element to extend over, and non-rotatably engage, the outer surface of the nut. In preferred embodiments, the coaxial connector is an axial compression-style connector, and activation of the compression tool simultaneously secures the prepared end of the coaxial cable within the body of the connector.

The outer surface of the tubular grip element may be generally cylindrical. Alternatively, the outer surface of the tubular grip element may be formed as a series of flattened surfaces or flats, optionally joined to each other by rounded surface edge portions. The inner bore of the tubular grip element may be generally cylindrical, or alternatively, hex-shaped to match the outer contour of the coupling nut.

Apart from the above-described method, another aspect of the present invention relates to a coaxial cable connector that includes a coaxial connector having a generally-cylindrical body for receiving a prepared end of a coaxial cable, and including a nut rotatably secured to the body for securing the connector onto a coaxial port. The coaxial cable connector further includes a tubular grip element having an outer surface and an internal bore. The tubular grip element has an axial length that exceeds the axial length of the nut. The internal bore of the tubular grip element preferably has an inner diameter of at least the outer diameter of the connector body for allowing the connector body to be disposed within the internal bore of the tubular grip element.

The tubular grip element is axially-slidable, relative to the body of the connector, for being axially advanced to extend over, and non-rotatably engage, an outer surface portion of the nut. In this manner, the outer surface of the tubular grip element provides a surface that can be grasped by the fingers of a user to facilitate tightening of the nut to a coaxial port. Preferably, the axial advancement of the tubular grip element over the nut results in a fixed engagement therebetween. As mentioned above, the outer surface of the tubular grip element may be cylindrical; alternatively, the outer surface of the tubular grip element may be formed by a series of flattened surfaces, or flats, optionally joined to each other by rounded surfaces. In one preferred embodiment, the inner wall defining the inner bore of the tubular grip element includes a reduced-diameter internal reinforcing rib, preferably disposed generally proximate the central portion of the tubular grip element to resist collapse of the tubular grip element as a user rotates the tubular grip element to tighten or un-tighten the coupling nut relative to an equipment port.

DETAILED DESCRIPTION OF THE PREFERRED EMBODIMENTS

Figure 1:
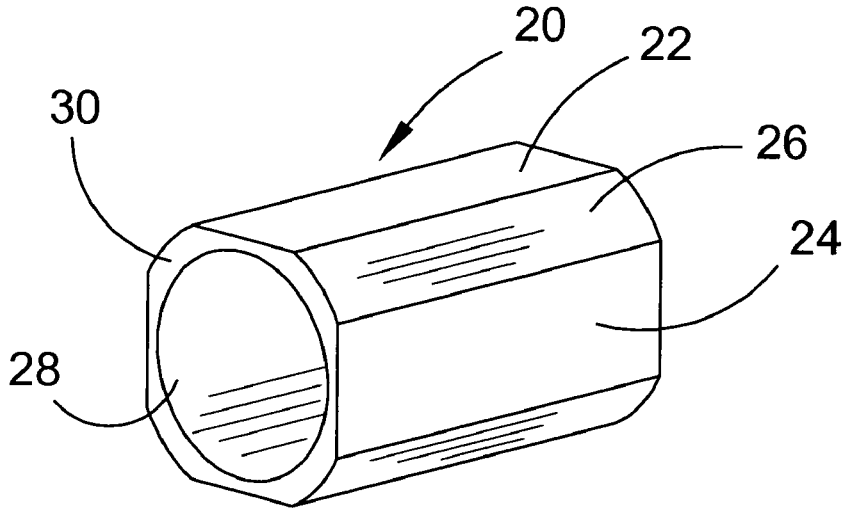
FIG. 1 is a perspective view of a first embodiment of a tubular grip element for use with a coaxial connector and having four flattened outer faces joined by rounded corners.

FIG. 1 illustrates a first embodiment of a tubular grip element, designated generally by reference numeral 20, for use with a coaxial connector. Tubular grip element 20 is preferably made of plastic and may be molded or machined to shape. In the preferred embodiments, tubular grip element 20 is made from Acetal plastic material. Acetal is a crystalline thermoplastic polymer with a high melting point, and a high modulus of elasticity. Acetal plastic material provides good strength, stiffness, resistance to abrasion, dimensional stability, and resistance to moisture. The homopolymer form of Acetal resin is commercially available under the registered trademark DELRIN® from E. I. duPont de Nemours & Co. of Wilmington, Del. and its distributors. In practicing the preferred embodiments described herein, the preferred manufacturing method is injection molding of the Acetal plastic resin.

Tubular grip element 20 has an outer surface that includes four flattened outer faces, or "flats", two of which (22 and 24) are visible in FIG. 1. Within the end view shown in FIG. 3, it will be seen that the four flats 22, 24, 32 and 36 are joined by rounded corner portions 26, 34, 38 and 40. The outer surface of tubular grip element 20 is configured and dimensioned so that it will fit into the compression chamber of an industry-standard coaxial connector axial compression tool, such as the TerminX® Series of axial compression tool sold by Ben Hughes Communication Products Company, doing business as CablePrep, of Chester, Conn. The rounded corners (26, 34, 38 and 40) are preferred and not only facilitate the insertion of tubular grip element 20 into an axial compression tool, but also result in minimum centerto-center spacing during rotation of tubular grip element 20 after it is installed over the coupling nut of a coaxial connector.

Figure 2:
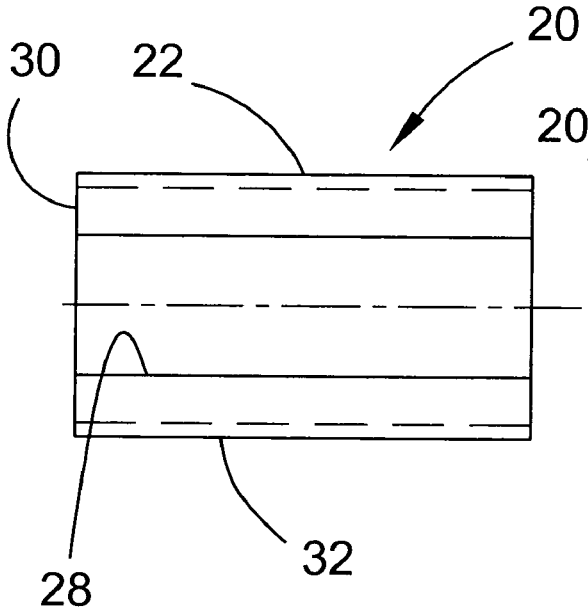
FIG. 2 is a longitudinal cross-sectional view of the tubular grip element shown in FIG. 1.
Figure 3:
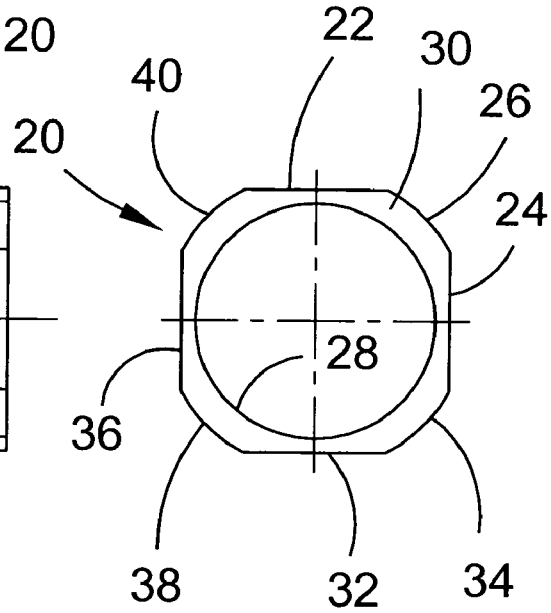
FIG. 3 is an end view of the tubular grip element shown in FIGS. 1 and 2.

Tubular grip element 20 has an internal bore 28 extending therethrough along the axial length thereof. One end of internal bore 28 can be seen in FIG. 1 extending into end face 30. As shown in FIGS. 1–3, internal bore 28 is circular in cross-section and is defined by a generally cylindrical inner wall. In another embodiment described below, the inner bore of the tubular grip element is instead formed to have a hexagonal shape. Internal bore 28 has an inner diameter that is generally commensurate with, and preferably slightly greater than, the outer diameter of the body portion of conventional F-style coaxial connectors, for reasons to be explained below. The overall axial length of tubular grip element 20 is preferably greater than the length of the coupling nut typically installed on F-style coaxial connectors, for reasons explained more fully below.

Figure 4:
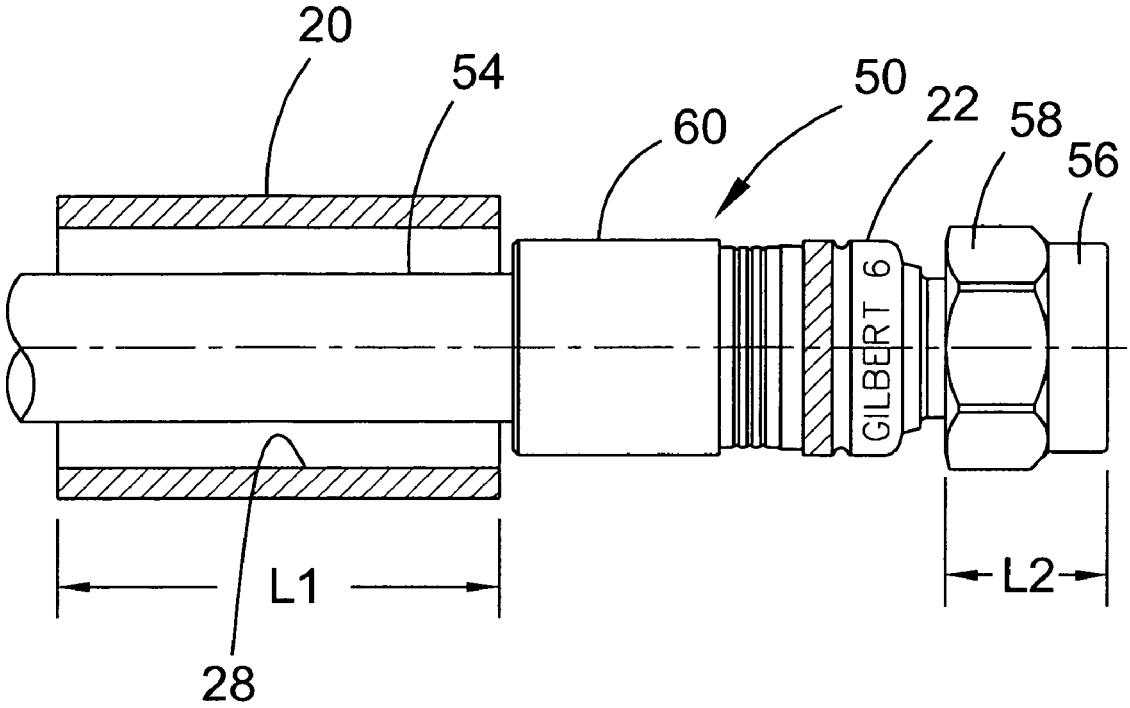
FIG. 4 is a side view of a coaxial connector into which the prepared end of a coaxial cable has been inserted, and wherein the tubular grip element of FIGS. 1–3 has been inserted over such coaxial cable.
Figure 5:
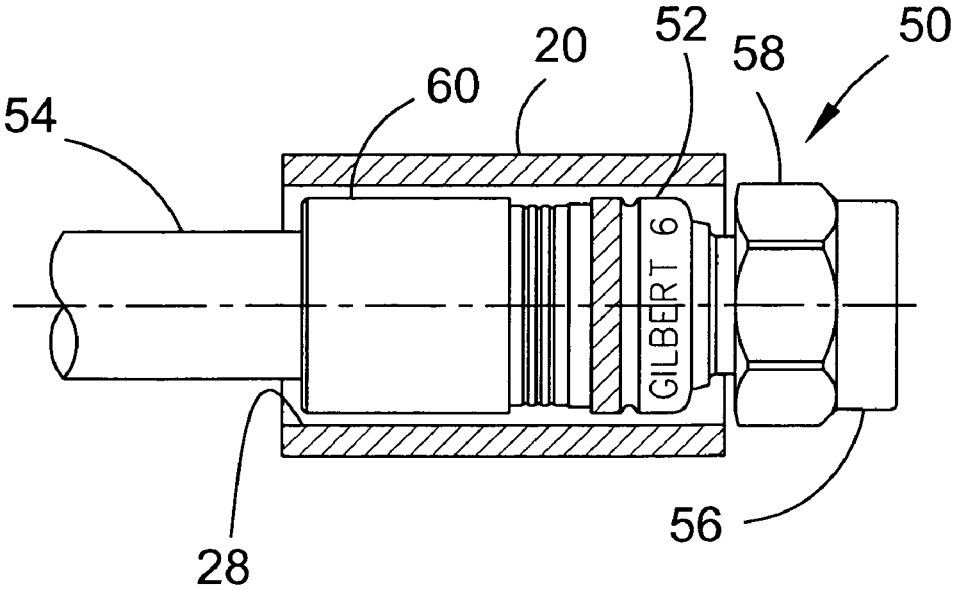
FIG. 5 is a side view of the components shown in FIG. 4 wherein the tubular grip element has been slid over the body portion of the coaxial connector prior to axial compression.
Figure 6:
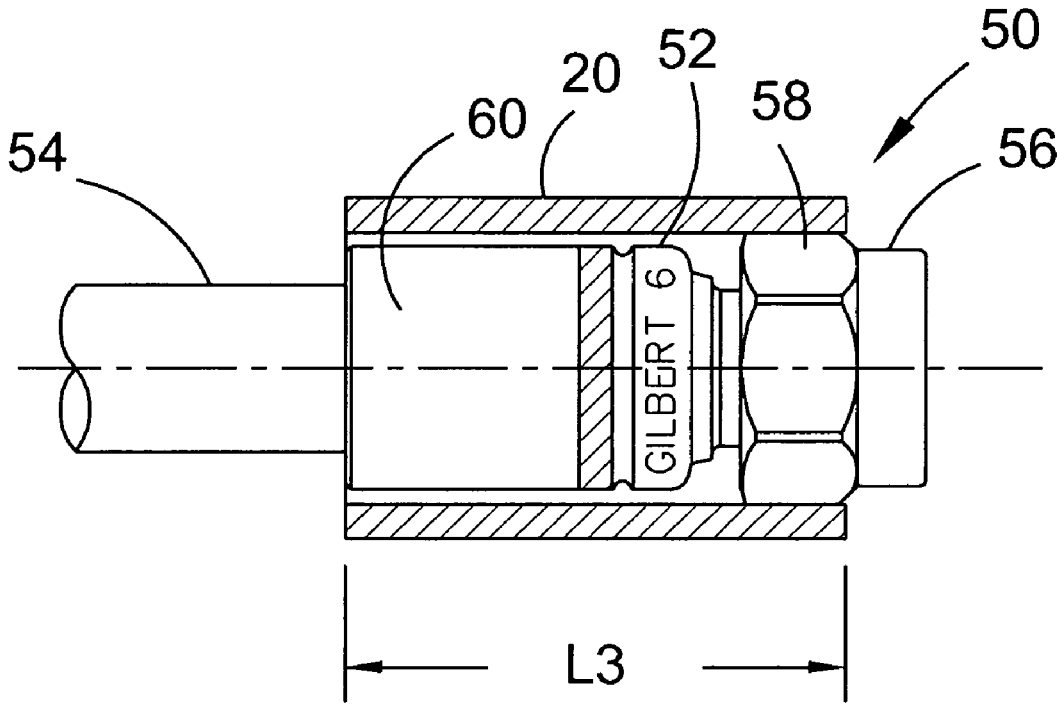
FIG. 6 is a side view of the components shown in FIG. 5 following axial compression of the connector, with the tubular grip element advanced to its fully-installed position.

Referring now to FIGS. 4–6, the manner in which tubular grip member 20 is used in conjunction with a conventional F-style coaxial connector will now be explained. In FIGS. 4–6, an axial compression F-style coaxial connector is designated generally by reference numeral 50. Coaxial connector 50 includes a generally-cylindrical body 52 for receiving a prepared end of coaxial cable 54. Coaxial connector 50 also includes a coupling nut 56 rotatably secured to body 52 for securing connector 50 onto a coaxial port. Coupling nut 56 typically includes an enlarged hex-shaped band 58 having flats that would ordinarily be engaged by an installation wrench when tightening nut 56 over an equipment port. Within FIG. 4, the axial length of coupling nut 56 is designated by dimension line L2, while the axial length of tubular grip element 20 is designated by dimension line L1. While not illustrated in FIGS. 4–6, a tubular post is ordinarily included inside body 52 for extending around the dielectric layer and center conductor of cable 54, and for insertion within the outer conductor of cable 54. Connector 50 also includes a compression sleeve 60 which can be axially compressed over body 52 toward coupling nut 56 for locking the end of cable 54 inside body 52 of connector 50.

As shown in FIG. 4, tubular grip element 20 is inserted over the prepared end of cable 54 and is moved along cable 54 for a short distance away from the end of cable 54. Tubular grip element 20 is preferably symmetrical, and it may therefore be inserted in either direction, and hence, no special orientation is required. The prepared end of cable 54 is then inserted into the open end of body 52 of connector 50. As used herein, the term "prepared end" of the cable refers to the end of a coaxial cable that has been prepared, for example, by trimming away a portion of the protective outer jacket, wherein the exposed outer conductor braid has been folded back over itself, and wherein the end portion of the dielectric is trimmed away to expose a short length of the center conductor in a manner well known to those skilled in the art. As shown in FIG. 5, tubular grip element 20 is then advanced, preferably by hand, toward coupling nut 56, over compression sleeve 60 and over body 52. To facilitate this process, the inner diameter of internal bore 28 of tubular grip element 20 is at least as large as, and preferably, slightly greater than the outer diameters of compression sleeve 60 and body 52.

Alternatively, it is possible to first slip internal bore 28 of tubular grip element 20 over compression sleeve 60 and body 52 (as per FIG. 5), and then to insert the prepared end of cable 54 into the open end of body 52, if desired. However, the above-described method shown in FIG. 4 is preferred, as the user can more easily observe the open end of the connector, while inserting the prepared end of cable 54 therein, if tubular grip element 20 is retracted back along cable 54.

Once cable 54, connector 50, and tubular grip element 20 are assembled into the configuration shown in FIG. 5, the assembly is ready to be axially compressed, typically by using an axial compression tool. During such axial compression, compression sleeve 60 is axially advanced over body 52 toward coupling nut 56, locking the prepared end of cable 54 inside connector 50. Simultaneously, tubular grip element 20 is forced to slide axially, relative to body 52, at least partially over enlarged hexagonal band 58 of connector 56. The internal bore 28 of tubular grip element 20 is preferably slightly smaller than the largest diametrical dimension of hexagonal band 58; accordingly, as tubular grip element 20 is forced over coupling nut 56, a press-fit engagement is preferably formed between internal bore 28 of tubular grip element 20 and the enlarged hexagonal band 58 of nut 56. Although enlarged band 58 is illustrated as having a hexagonal shape (as is customary for F-style connectors), the outer surface of coupling nut 56 can be of virtually any shape or texture that achieves engagement between tubular grip element 20 and coupling nut 56 when tubular grip element is axially advanced over coupling nut 56. Thereafter, tubular grip element provides a gripping surface that can readily be grasped by the fingers of a user to facilitate tightening of the nut to a coaxial equipment port.

As is shown in FIG. 6, tubular grip element 20 has an axial length (L1 in FIG. 4) that exceeds the axial length (L2 in FIG. 4) of coupling nut 56. In this manner, tubular grip element 20 serves to extend the gripping area of coupling nut 56 for finger tightening (or un-tightening) of the completed assembly onto an equipment port. Moreover, because the outer surface of tubular grip element 20 has an outer diametrical dimension that is greater than that of coupling nut 56, the user can exert greater leverage when rotating coupling nut 56. In addition, because of the extended axial length provided by tubular grip element 20, a user can easily rotate coupling nut 56 even when connector 50 must be attached to a recessed equipment port.

Figure 7:
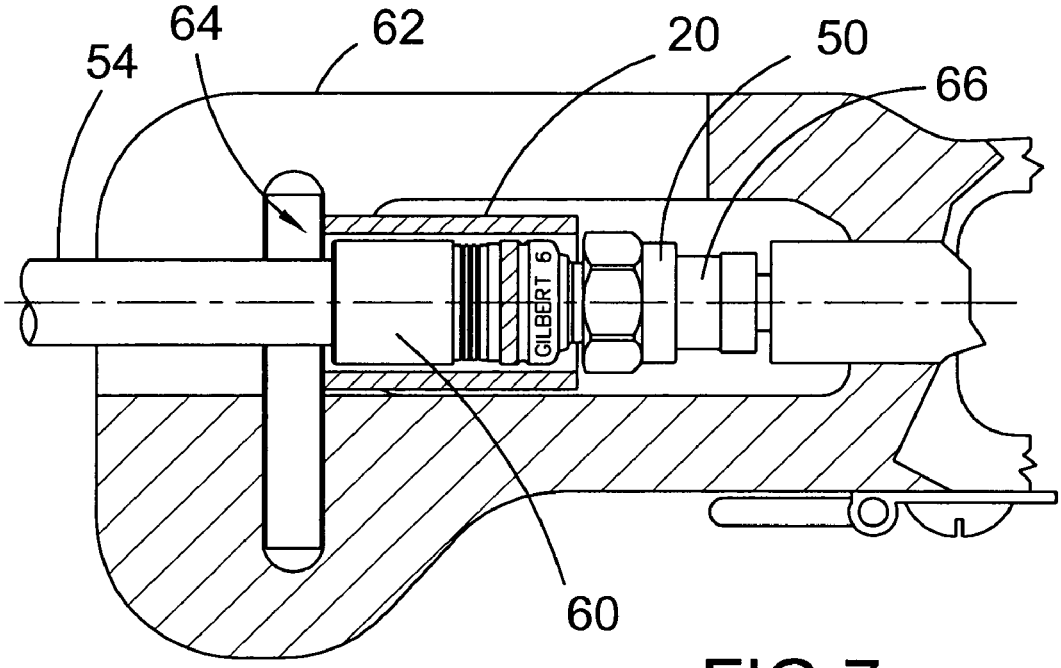
FIG. 7 is a partial, cut-away view of the components shown in FIG. 5 installed within the working jaws of a conventional axial compression tool prior to activation of such tool.
Figure 8:
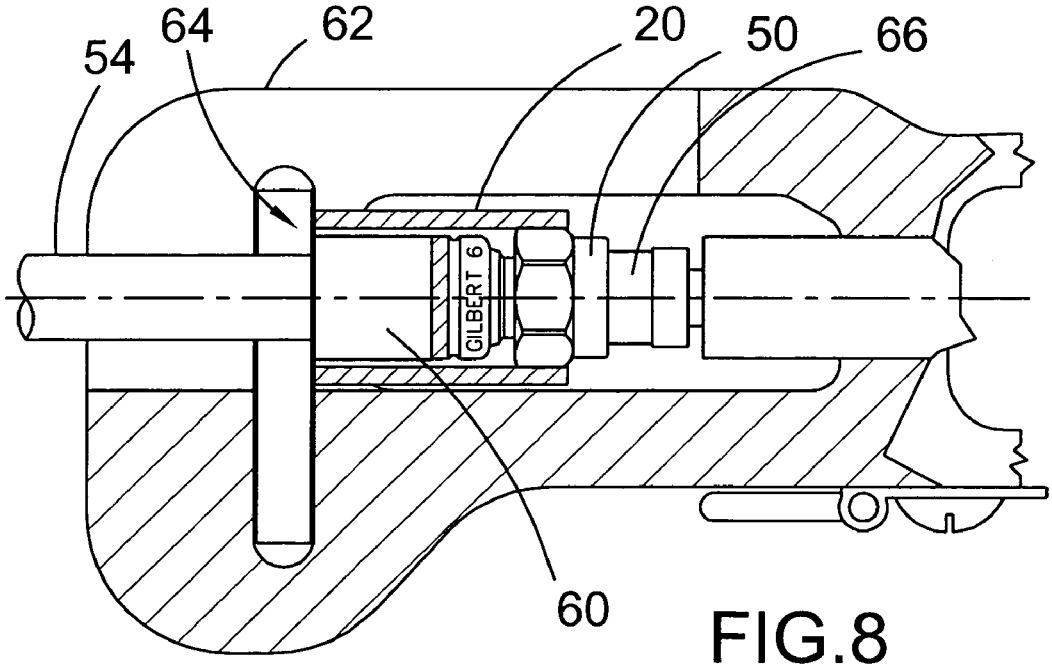
FIG. 8 is a partial, cut-away view of the components shown in FIG. 6 installed within the same working jaws of the conventional axial compression tool, following activation of such tool.

The method of installing tubular grip element 20 using an axial compression tool is more specifically illustrated in FIGS. 7 and 8. In FIG. 7, coaxial connector 50, coaxial cable 54, and tubular grip element 20 are inserted into the compression chamber of industry-standard axial compression tool 62; as mentioned above, one example of such a tool is the TerminX® Series of axial compression tools available from Ben Hughes Communication Products Company ("CablePrep"). In FIG. 7, the components are shown in the configuration already illustrated in FIG. 5, i.e., the "opened" position before axial compression. The compression chamber of axial compression tool 62 includes a fixed jaw 64 and a movable jaw 66. Fixed jaw 64 supports the cable end of coaxial connector 50, while allowing coaxial cable 54 to protrude therefrom. Movable jaw 66 engages the open end of the coupling nut of connector 50 and can be axially advanced toward fixed jaw 64 when the handles (not shown) of tool 62 are squeezed by an installer. As noted above, the outer surface of tubular grip element 20 is configured and dimensioned so that it will fit into fixed jaw 64 of axial compression tool 62 without creating interference.

FIG. 8 shows the same axial compression tool and coaxial connector assembly as depicted in FIG. 7, but after compression tool 62 has been activated to its "closed" position. The coaxial connector assembly shown in FIG. 8 corresponds to the "closed" position already shown in FIG. 6. As shown in FIG. 8, activation of compression tool 62 accomplishes two tasks simultaneously. First, compression sleeve 60 is compressed over the body of connector 50 to secure connector 50 to the end of cable 54. Secondly, tubular grip element 20 is forced over the enlarged hexagonal surface of the coupling nut of connector 50, creating a press-fit connection between tubular grip element 20 and the coupling nut. Axial compression tool 62 is then opened, and the completed coaxial connector assembly is removed therefrom. Preferably, the axial length of tubular grip element 20 (L1 in FIG. 4) is between two and four times the axial length (L2 in FIG. 4) of coupling nut 56. Following axial compression, tubular grip element 20 preferably extends from the rear end of compression sleeve 60 (which is also the rear end of connector 50) to at least a point forward of the rear end of the enlarged hexagonal band 58 of coupling nut 56; the forward end of tubular grip element 20 extends sufficiently past the rear end of enlarged hexagonal band 58 to allow tubular grip element 20 to reliably engage enlarged band 58 for rotation thereby. Preferably, following axial compression, tubular grip element 20 extends approximately between the rear end of compression sleeve 60 and the front end of the enlarged hexagonal band 58 of coupling nut 56, as designated by axial length dimension line L3 in FIG. 6. In some preferred embodiments, the front end of the tubular grip element 20 is flush with the front end of the band 58 following axial compression.

Figure 9:
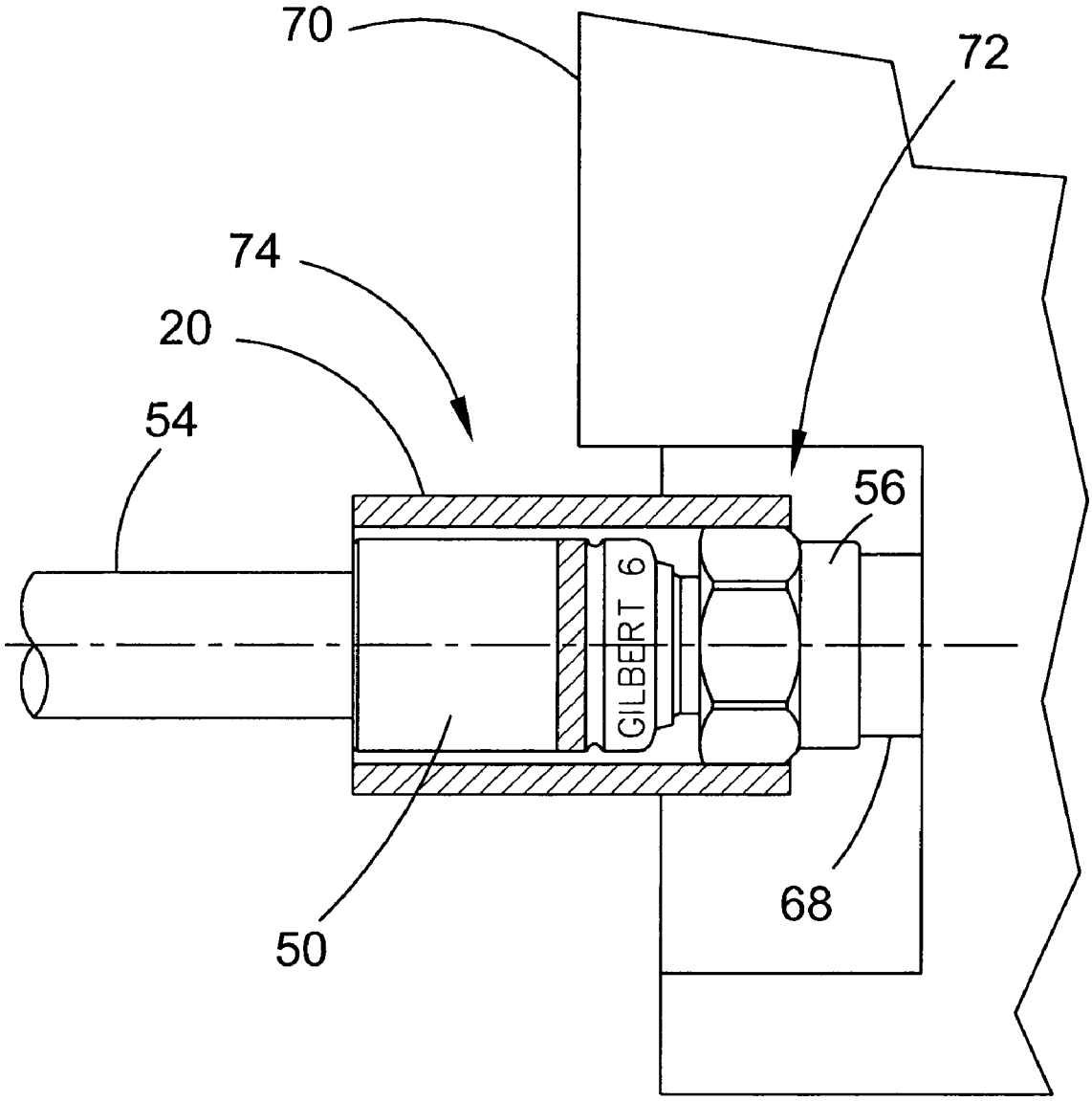
FIG. 9 is a side view of the components shown in FIG. 6 installed over a recessed coaxial port and illustrating how the tubular grip element facilitates access to the coupling nut for tightening the same over the recessed coaxial port.

FIG. 9 shows the coaxial connector assembly of FIG. 6, including connector 50, cable 54, and tubular grip element 20, threadedly-engaged to equipment port 68 extending from an equipment box, such as a television or VCR 70. Many such equipment boxes 70 position the coaxial equipment port 68 within a recessed area 72. Often, recessed area 72 makes it difficult to reach coupling nut 56 directly with one's fingers. Advantageously, tubular grip element 20 provides an extended external gripping surface area 74 allowing a user to rotate coupling nut 56, and easily hand tighten connector 50 to equipment port 68, notwithstanding recess 72.

Figure 10:
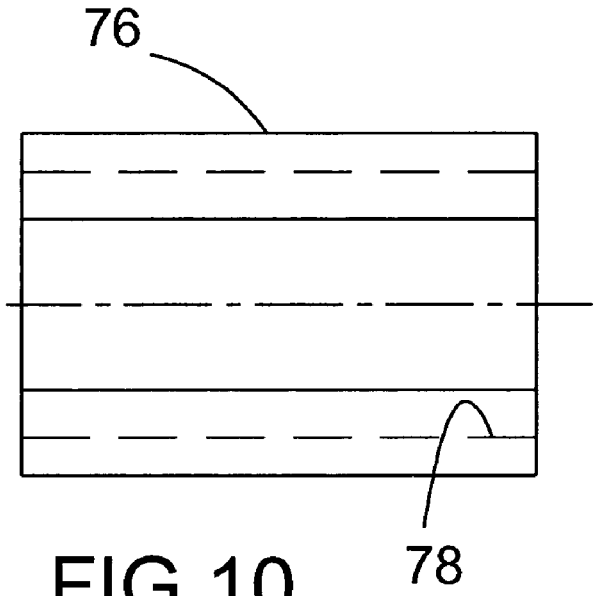
FIG. 10 is a side view of an alternative embodiment of a tubular grip element using six flattened surfaces instead of the four flattened surfaces shown in FIGS. 1–3.
Figure 11:
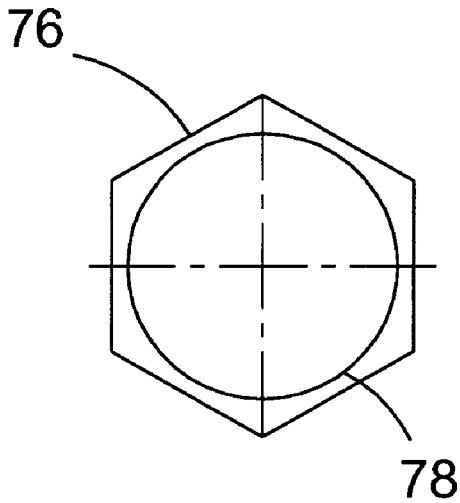
FIG. 11 is an end view of the tubular grip element shown in FIG. 10.

FIGS. 10 and 11 illustrate an alternative embodiment of a tubular grip element, designated generally by reference numeral 76 and including a circular internal bore 78. Whereas the tubular grip member 20 of FIGS. 1–3 includes four flats arranged at 90 degree intervals forming a generally square shape, tubular grip element 76 includes six flats arranged at 60 degree intervals forming a generally hexagonal shape. The points at which the edges of such flats meet need not be rounded in order to permit tubular grip element 76 to fit within a typical axial compression tool.

Figure 12:
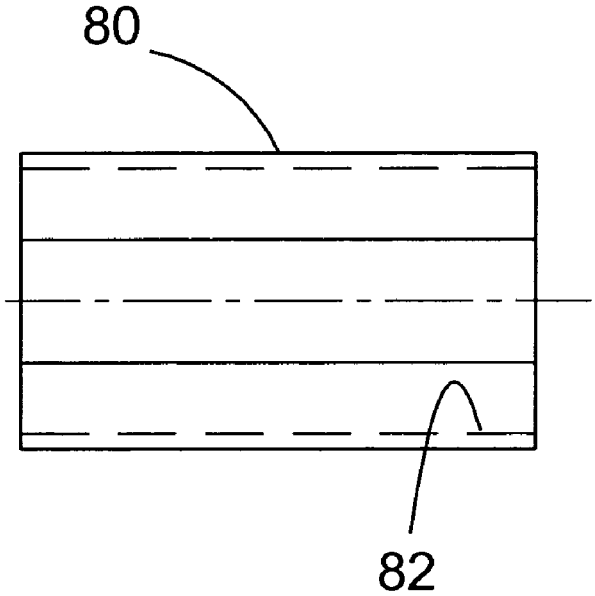
FIG. 12 is a side view of an alternative embodiment of a tubular grip element using eight flattened surfaces instead of the four flattened surfaces shown in FIGS. 1–3.
Figure 13:
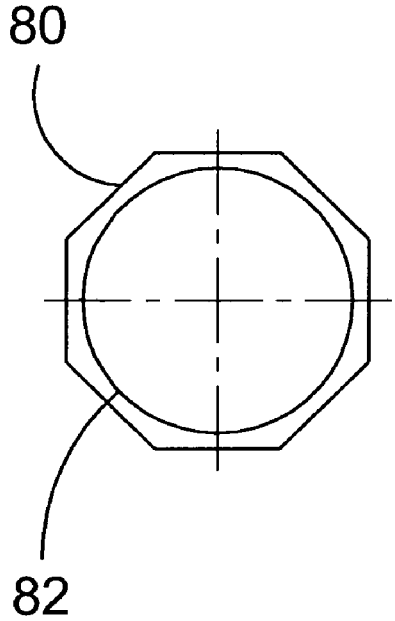
FIG. 13 is an end view of the tubular grip element shown in FIG. 12.

FIGS. 12 and 13 illustrate another alternative embodiment of a tubular grip element, designated generally by reference numeral 80 and including a circular internal bore 82. Whereas the tubular grip member 20 of FIGS. 1–3 includes four flats forming a generally square shape, tubular grip element 80 of FIGS. 12 and 13 includes eight flats arranged at 45 degree intervals forming a generally octagonal shape.

Figure 14:
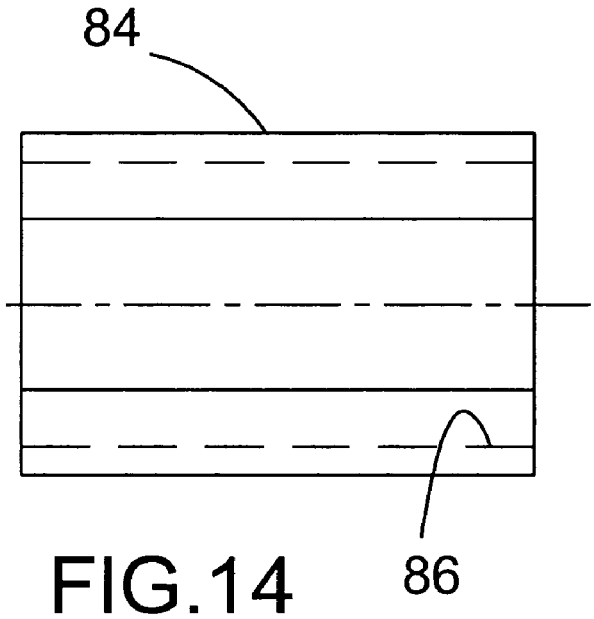
FIG. 14 is a side view of an alternative embodiment of a tubular grip element, similar to that shown in FIGS. 10 and 11, but having a hex-shaped inner bore.
Figure 15:
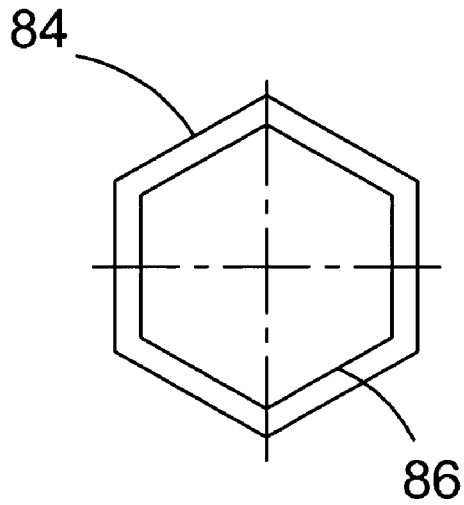
FIG. 15 is an end view of the tubular grip element shown in FIG. 14.

FIGS. 14 and 15 illustrate yet another alternative embodiment of a tubular grip element, designated generally by reference numeral 84 and including an internal passage 86. The outer surface of tubular grip element 84 includes six flats forming a hexagonal shape, like that shown in FIGS. 10 and 11. However, the center passage 86 of tubular grip element 84 has a hexagonal shape, corresponding to the hexagonal shape of the enlarged band 58 of coupling nut 56 (see FIG. 4).

Figure 16:
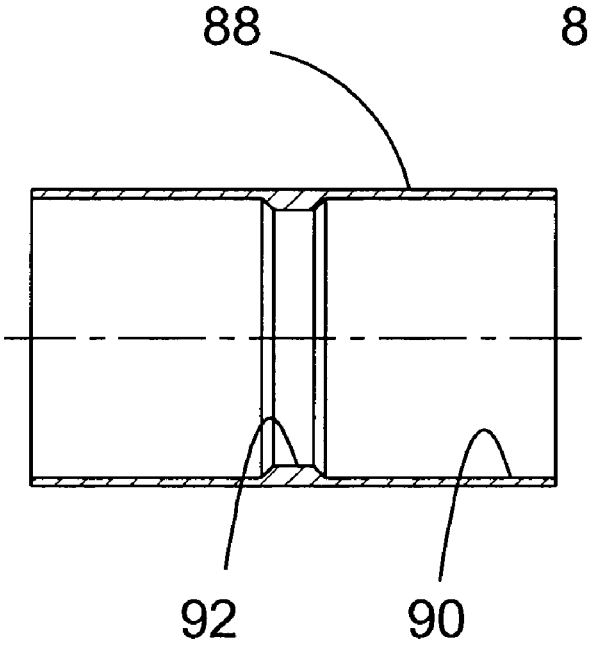
FIG. 16 is a longitudinal cross-sectional view of an alternative embodiment of a tubular grip element, similar to that shown in FIGS. 1–3, but wherein the internal bore includes a reduced diameter rib in the central region thereof.
Figure 17:
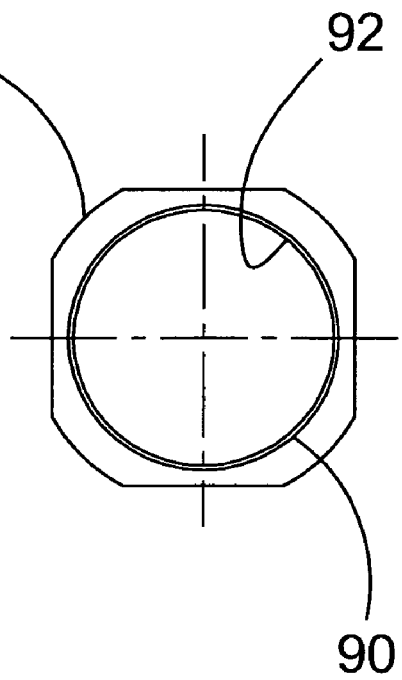
FIG. 17 is an end view of the tubular grip element shown in FIG. 16.

FIGS. 16 and 17 depict a tubular grip element 88 incorporating a modification of tubular grip element 20 shown in FIGS. 1–3. A reduced diameter internal rib 92 is formed by the inner wall approximately midway within the central passage 90. Rib 92 serves to increase the wall thickness, and hence, the strength of tubular grip element 88, and helps to prevent the collapse of tubular grip element 88 against the connector body as a user rotates tubular grip element 88 to tighten the coupling nut to an equipment port.

Those skilled in the art will now appreciate that a coaxial connector has been described that can be easily, quickly, and reliably installed by hand over an equipment port. The tubular grip element described above provides a torque aid that is easily installed onto conventional compression-type F-connectors. The torque aid is inexpensive to manufacture, fits existing axial compression tools currently used in the field, and does not significantly complicate procedures already used to assemble F-style compression connectors onto coaxial cables. Moreover, the same tubular grip element can be used with a variety of existing coaxial connectors, and avoids the need for an installer to carry extraneous specialty connectors. The described tubular grip element allows the coupling nut of a coaxial connector to be more easily grasped, and avoids the need for wrenches or other installation tools when tightening the coaxial connector to an equipment port. In addition, the described coaxial connector facilitates tightening (or un-tightening) of the coupling nut to an equipment port located in a recessed area of a television set or other electronic equipment.

Likewise, an improved method has been described to facilitate the tightening of an axial compression-type coaxial connector onto a coaxial port. The tubular grip element can be installed simultaneously with the axial compression of the connector using conventional field compression tools.

While the present invention has been described with respect to preferred embodiments thereof, such description is for illustrative purposes only, and is not to be construed as limiting the scope of the invention. Various modifications and changes may be made to the described embodiments by those skilled in the art without departing from the true spirit and scope of the invention as defined by the appended claims.

We claim:

1. A method for facilitating rotation of a coaxial connector relative to a coaxial port, said method comprising the steps of:

a. providing a coaxial connector, the connector including a generally-cylindrical body for receiving a prepared end of a coaxial cable, and including a nut rotatably secured to the body for securing the connector onto a coaxial port, the nut including an outer surface;

b. providing a tubular grip element having an outer surface, an axial length, and an internal bore having a first end and an opposite second end, the internal bore having a circular cross-section with a constant inner diameter extending from the first end to the second end;

c. inserting the prepared end of a coaxial cable inside the body;

d. disposing the body of the connector inside the internal bore of the tubular grip element;

e. following steps c) and d), inserting the connector, tubular grip element, and coaxial cable into an axial compression tool; and f. activating the axial compression tool to axially advance the tubular grip element to extend over, and non-rotatably press-fit engage, an outer surface portion of the nut.

2. The method of claim 1 wherein the coaxial connector is an axial compression-style coaxial connector, and wherein said activating step includes the step of securing the prepared end of the coaxial cable within the body simultaneously with the axial advancement of the tubular grip element over the outer surface portion of the nut.

3. The method of claim 1 wherein the nut of the coaxial connector has an axial length, and wherein the tubular grip element has an axial length, the axial length of the tubular grip element exceeding the axial length of the nut.

4. The method of claim 1 wherein the outer surface of the tubular grip element has a cylindrical surface.

5. The method of claim 1 wherein the outer surface of the tubular grip element comprises a plurality of flats.

6. The method of claim 5 wherein adjacent flats are joined to each other along common edges, and wherein each common edge is rounded.

7. The method of claim 5 wherein the plurality of flats includes four such flats.

8. The method of claim 5 wherein the plurality of flats includes six such flats.

9. The method of claim 5 wherein the plurality of flats includes eight such flats.

10. The method of claim 1 wherein step c) is performed before step d).

11. The method of claim 10 further including the step of inserting the prepared end of the coaxial cable inside the internal bore of the tubular grip element, and sliding the tubular grip element back along the coaxial cable, before performing step c).

12. A coaxial cable connector comprising in combination:

a. a coaxial connector, the connector including a generally-cylindrical body for receiving a prepared end of a coaxial cable, and including a nut rotatably secured to the body for securing the connector onto a coaxial port, the nut having an axial length and including an outer surface, and the body having an outer diameter of a predetermined dimension; and b. a tubular grip element having an outer surface, an axial length, and an internal bore having a first end and an opposite second end, the tubular grip element having an axial length exceeding the axial length of the nut, the internal bore having a circular cross-section with a constant inner diameter extending from the first end to the second end, the body of the connector being disposed inside the internal bore of the tubular grip element, the tubular grip element being axially-slidable, relative to the body of the connector, for being axially advanced to extend over, and non-rotatably press-fit engage, an outer surface portion of the nut, the outer surface of the tubular grip element providing a surface that can be grasped by the fingers of a user to facilitate tightening of the nut to a coaxial port.

13. The coaxial cable connector of claim 12 wherein the tubular grip element fixedly engages the outer surface portion of the nut when axially advanced to extend over the outer surface portion of the nut.

14. The coaxial cable connector of claim 12 wherein the outer surface of the tubular grip element has a cylindrical surface.

15. The coaxial cable connector of claim 12 wherein the outer surface of the tubular grip element comprises a plurality of flats.

16. The coaxial cable connector of claim 15 wherein adjacent flats are joined to each other along common edges, and wherein each common edge is rounded.

17. The coaxial cable connector of claim 15 wherein the plurality of flats includes four such flats.

18. The coaxial cable connector of claim 15 wherein the plurality of flats includes six such flats.

19. The coaxial cable connector of claim 15 wherein the plurality of flats includes eight such flats.

20. The coaxial cable connector of claim 12 wherein the internal bore of the tubular grip element is defined by an inner wall, and wherein the inner wall of the tubular grip element includes a reduced-diameter reinforcing rib to resist collapse of the tubular grip element as a user rotates the tubular grip element to rotate the coupling nut relative to an equipment port.

21. The coaxial cable connector of claim 20 wherein the reinforcing rib is disposed generally proximate the central portion of the tubular grip element.

22. A coaxial cable connector comprising in combination:

a. a coaxial connector, the connector including a generally-cylindrical body for receiving a prepared end of a coaxial cable, and including a nut rotatably secured to the body for securing the connector onto a coaxial port, the nut having an axial length and including an outer surface; and b. a tubular grip element having an outer surface and an internal bore, the tubular grip element having an axial length exceeding the axial length of the nut, the body of the connector being disposed inside the internal bore of the tubular grip element, the tubular grip element being axially-slidable, relative to the body of the connector, for being axially advanced to extend over, and non-rotatably engage, an outer surface portion of the nut, the outer surface of the tubular grip element providing a surface that can be grasped by the fingers of a user to facilitate tightening of the nut to a coaxial port;

wherein the internal bore of the tubular grip element is defined by an inner wall, and wherein the inner wall of the tubular grip element includes a reduced-diameter reinforcing rib to resist collapse of the tubular grip element as a user rotates the tubular grip element to rotate the coupling nut relative to an equipment port.

23. The coaxial cable connector of claim 22 wherein the reinforcing rib is disposed generally proximate the central portion of the tubular grip element.

24. A coaxial cable connector assembly comprising:

a. a coaxial connector, the connector including a generally-cylindrical body for receiving a prepared end of a coaxial cable, and including a nut rotatably secured to the body for securing the connector onto a coaxial port, the nut having an axial length and including an outer surface; and b. a tubular grip element having an outer surface, an axial length, and an internal bore having a first end and an opposite second end, the tubular grip element having an axial length exceeding the axial length of the nut, the internal bore having a circular cross-section with a constant inner diameter extending from the first end to the second end, the body of the connector being disposed inside the internal bore of the tubular grip element, wherein the tubular grip element extends over, and non-rotatably press-fit engages, an outer surface portion of the nut, the outer surface of the tubular grip element providing a surface that can be grasped by the fingers of a user to facilitate tightening of the nut to a coaxial port.

* * * * *